US005173975A

United States Patent [19]

Peterson

[11] Patent Number: 5,173,975

[45] Date of Patent: Dec. 29, 1992

[54] ADJUSTABLE BED WITH SIDE RAIL

[75] Inventor: Warren J. Peterson, Stevens Point, Wis.

[73] Assignee: Joerns Healthcare, Inc., Stevens Point, Wis.

[21] Appl. No.: 872,632

[22] Filed: Apr. 22, 1992

Related U.S. Application Data

[60] Division of Ser. No. 722,091, Jun. 27, 1991, which is a continuation-in-part of Ser. No. 540,282, Jun. 18, 1990, Pat. No. 5,105,486.

[51] Int. Cl.[5] ..... A47C 21/08

[52] U.S. Cl. ..... 5/430; 5/428; 5/425

[58] Field of Search ..... 5/425-430

[56] References Cited

U.S. PATENT DOCUMENTS

| | | | |
|---|---|---|---|
| 2,817,855 | 12/1957 | Pratt | 5/430 |
| 3,823,428 | 7/1974 | Whyte | 5/429 |
| 3,855,654 | 12/1974 | Pivacek | 5/429 |
| 3,930,273 | 1/1976 | Stern | 5/430 |
| 3,932,903 | 1/1976 | Adams et al. | 5/430 X |
| 3,971,083 | 6/1976 | Peterson | 5/430 |
| 4,993,089 | 2/1991 | Solomon et al. | 5/430 |

*Primary Examiner*—Michael F. Trettel
*Attorney, Agent, or Firm*—Price, Heneveld, Cooper, DeWitt & Litton

[57] ABSTRACT

An adjustable bed includes a patient operated linear positioner, a rail assembly and a leg lift mechanism. The patient operated linear positioner includes a subassembly with a bellcrank which pivots by a patient operated soft strap. When the strap is pulled, the bellcrank pushes a cable inward which, in turn, releases a positioner rod so that the bed may be adjusted. The side rail assembly includes a J-shaped attachment bar and an idler link which acts to move the side rail both upward and forward when the head section of the adjustable bed is raised. A bed side rail may be attached to a bed frame through the use of a unique attachment mechanism which requires no tools. A further aspect of the invention utilizes a scissors-type leg lifting mechanism for holding and controlling the rate of collapsing movement of the foot section of a bed mattress frame. The leg lifting mechanism includes a mechanical lock and gas piston subassembly.

8 Claims, 7 Drawing Sheets

ADJUSTABLE BED WITH SIDE RAIL

CROSS REFERENCE TO RELATED APPLICATION

This application is a division of copending application Ser. No. 07/722,091 filed Jun. 27, 1991 which, inturn, was a continuation-in-part of Ser. No. 07/540,282 filed Jun. 18, 1990 and now U.S. Pat. No. 5,105,486, the disclosure of which is herein incorporated by reference.

BACKGROUND OF THE INVENTION

The present invention relates to healthcare beds and, more particularly, to manually adjustable mechanical beds and accessories therefore.

A wide variety of manually adjustable, multi-position beds are presently available. Such beds may be used in hospitals, nursing homes and other healthcare facilities. A typical hospital bed includes a mattress frame divided into a plurality of sections. The frame may include a head section, a seat section and a leg or foot section. The sections are positionable so that the patient may be moved from a flat, resting position to a raised, seated position where the patient's back is moved upwardly and the legs may be bent.

One drawback when using manually adjustable beds is the problem of providing the means for the occupant, rather than an attendant, to easily operate the pivotal action of the bed. Typically, if a patient desires to move the bed to a specific position, the patient would be required to operate position controls which are used by the attendant. These controls are generally located at one or both ends of the bed, which might require the patient to either leave the bed entirely or assume an awkward position. Obviously, in many situations, this is not possible for the occupant and would require an attendant to be present when the bed position needs to be adjusted.

It is also required that some type of device be placed along the edge of the bed in order to keep the occupant from falling or rolling from the mattress of the bed. This device is usually in the form of a rail which attaches to the mattress or bed frame and presents egress when in position. Often the rail assembly cannot be used with an adjustable bed since a mechanical assembly is needed to attach the rail to the mattress frame which ensures that the rail raises with the bed. Further, even when an assembly is provided, when a specific section of the bed is raised, a large gap can be created between the mattress and rail which defeats the function of the rail since the occupant may fall into the gap.

Another common problem when using an adjustable bed is the difficulty in providing a simple yet reliable mechanism for holding the foot section of the bed in a raised position. Typically, a mechanical jack or electric motor is included at the foot of the bed and acts to raise and hold that end of the mattress from the bed frame. These devices are large, heavy and slow in operation. They may also require a large number of parts and a complex arrangement for attaching the device to the bed and mattress frames.

A need exists for an adjustable bed with a patient actuated locking mechanism, a bed rail mechanism and a foot section locking device which are simple and easy to use, reliable and which may be used with a variety of different beds.

SUMMARY OF THE INVENTION

In accordance with the present invention, the aforementioned needs are fulfilled. An adjustable bed with pivotal sections includes a control mechanism which operates to both release and lock the sections in adjustable positions. The device uses a strap attached to a bellcrank which activates a push/pull cable. The cable operates to lock and release a mechanical locking mechanism which holds the bed sections in a fixed position. The mechanical locking mechanism can also be operated by a push/pull back control handle which connects the cable at its opposite end. The push/pull back control handle includes an override to accommodate the pushing movement of the locking cable when the patient strap is pulled.

A further improvement is made through the use of a side rail mechanism. A side rail is provided which includes links attached to a J-shaped attachment bar or bracket. The bracket is pivoted at one end to the rail section of the bed and at its opposite end to the foot section through an idler link. The side rail mechanism may also be assembled and disassembled without the use of tools through the use of a unique attachment bushing. Further, in order to limit any gap created when the head section of the bed is tilted, the idler link controls side rail movement, causing it to move both up and forward when the bed is tilted.

An additional improvement to an adjustable bed is made through the use of a knife-blade type lifting mechanism. The lifting mechanism can be substituted for a jack which lifts the mattress frame from the bed frame. The lifting mechanism permits the leg end of the mattress section to be lifted vertically and locked in position in order to tilt a patient. The mechanism utilizes a gas spring which provides a controlled rate of movement when lowering the bed into a flat position and a mechanical lock to position the mattress frame.

DETAILED DESCRIPTION OF THE PREFERRED EMBODIMENT

Figure 1:
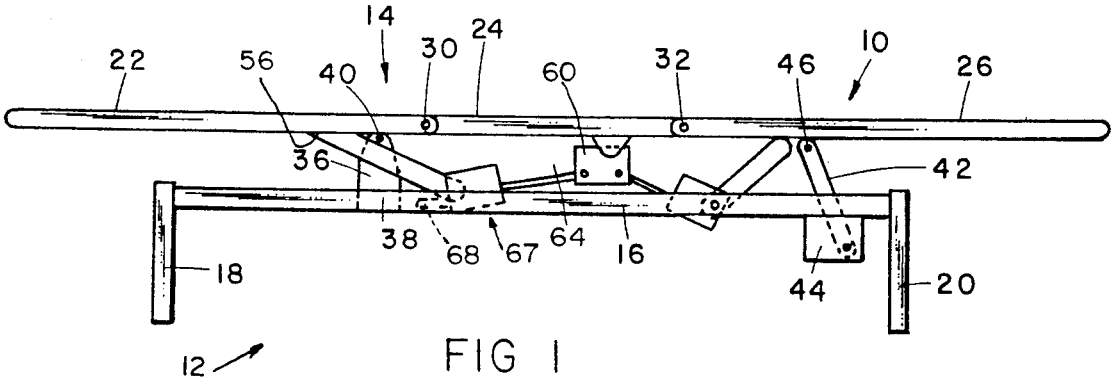
FIG. 1 is a side, elevational view of an adjustable bed showing a linear positioner incorporating the present invention.

An adjustable bed assembly in accordance with the present invention is illustrated in FIG. 1 and generally designated by the numeral 10. Bed 10 includes a base or subframe 12 and a mattress frame 14. Frame 12 includes elongated side members 16, a pair of legs 18 at the head portion of the frame and a pair of legs 20 at the foot portion or lower end of the frame. In the embodiment shown, mattress frame 14 includes a head or back section 22, a seat or intermediate section 24 and a foot or leg section 26. Section 22 is pivoted to section 24 at pivot 30. Section 24 is also pivoted to section 26 at a pivot 32. In the embodiment illustrated in FIG. 1, a mount secures frame 14 on subframe 12. As shown, the mount includes a support link 36 having a lower end 38 fixed to base frame 12 and an upper end 40 pivoted to head section 22. Another support link 42 includes a lower end 44 pivoted to base frame 12 and an upper end 46 pivoted to leg section 26 in the lower section of mattress frame 13.

Figure 2:
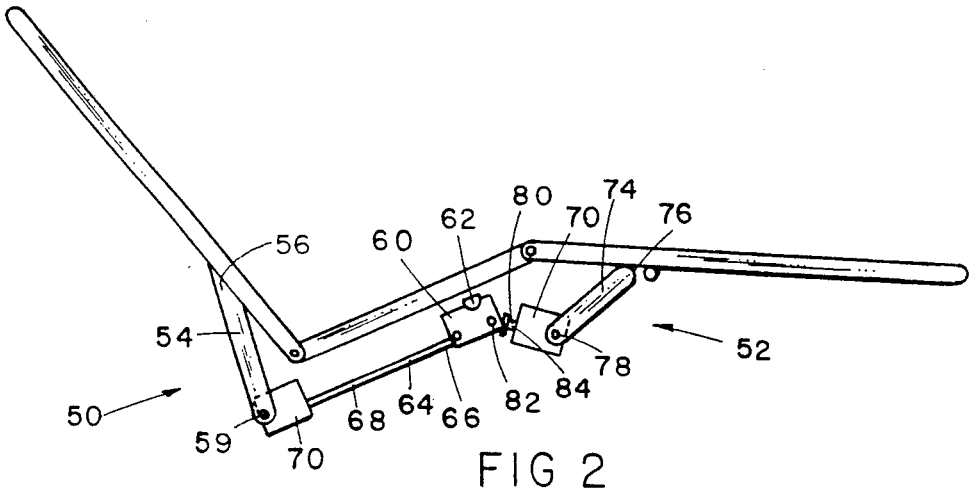
FIG. 2 is a side, elevational view of the portion of the bed of FIG. 1 showing the mattress frame in a contour position.

The mattress frame sections may be moved from the flat configuration shown in FIG. 1 to a contoured position shown in FIG. 2 wherein head section 22 is angled or tilted with respect to the base frame and the intermediate section 24 and wherein sections 24 and 26 are angularly related to form a "knee-break". Relative positioning of the sections with respect to each other is provided by link and positioner subassemblies 50, 52. As seen in FIGS. 1 and 2, subassembly 50 includes a first fixed link or strut 54 having an end 56 rigidly fixed to head section 22. Strut 54 defines a free end 59. A bracket 60 is fixed at an upper end thereof to intermediate section 24. A linear positioner 67 includes an elongated rod 64. Rod 64 includes an end 66 pivoted to bracket 60 and a free end 68. End 68 extends through a lock mechanism 70.

Subassembly 52 includes a fixed link or support structure 74 having an end 76 fixed to leg or foot section 26 and a free end 78. An elongated positioner rod 80 has an end 82 pivoted to bracket 60. A free end 84 of rod 80 extends to a lock mechanism 70. In the preferred embodiment, a gas spring or hydraulic damper, not shown, extends between bracket 60 and each of support struts 84, 74. The damper acts to control the movement of the bed sections.

As shown in FIGS. 1 and 2, head section 22, intermediate section 24 and the lock and positioner subassemblies define a three-bar linkage. The first link includes head section 22 and fixed strut 54. The second link includes intermediate section 24, and the third link includes linear positioner. Elongated rod 64 gives the third link a variable length.

Figure 3:
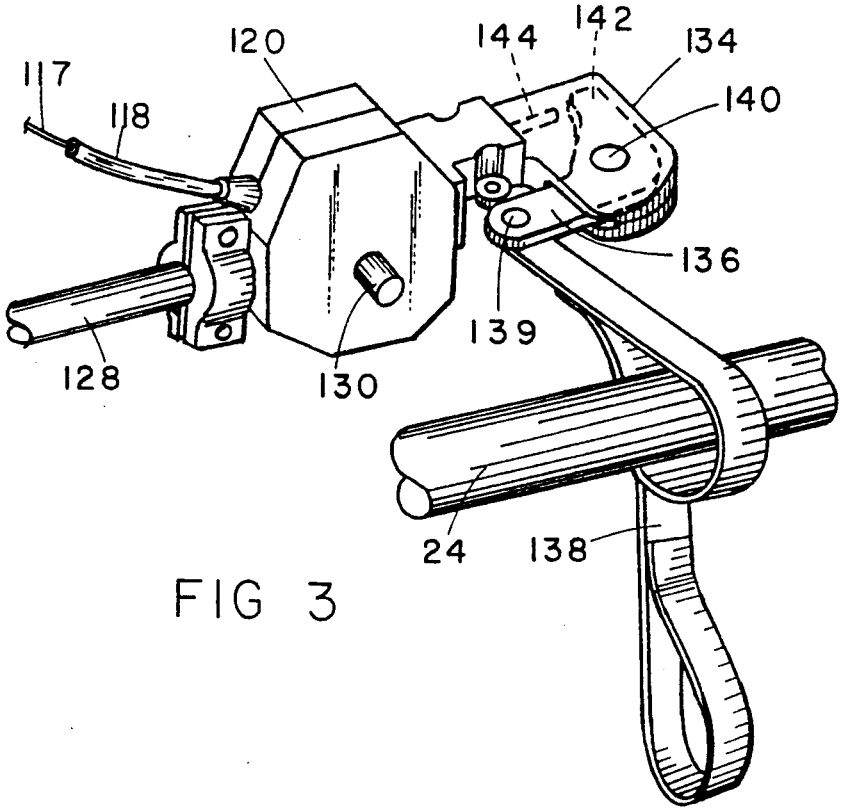
FIG. 3 is a fragmentary, perspective view of the occupant operated linear positioner assembly.
Figure 4:
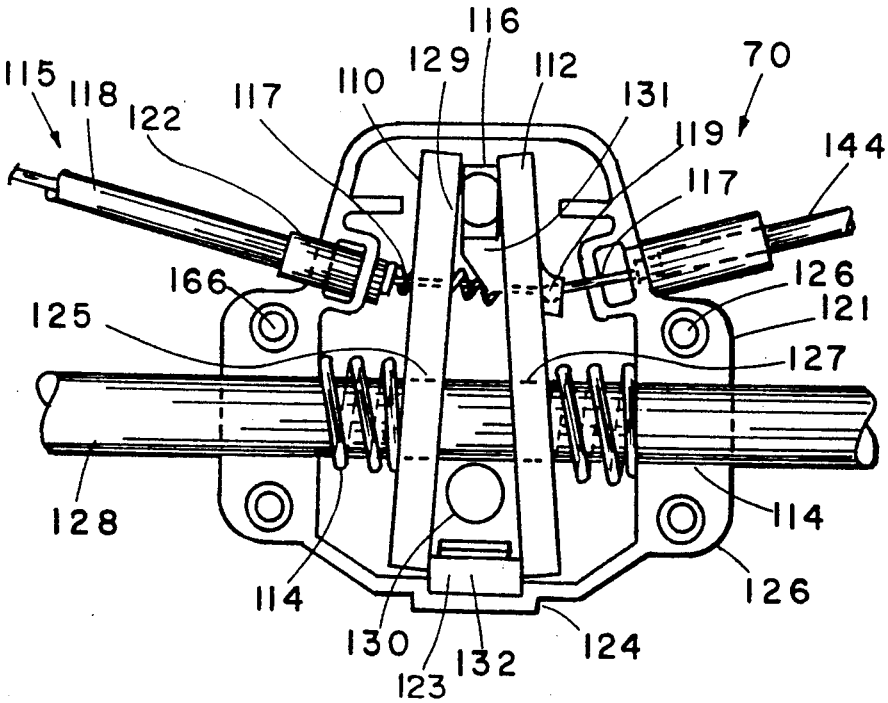
FIG. 4 is a fragmentary, side, elevational view of the locking mechanism incorporated in the linear positioner.

As shown in FIGS. 3 and 4, mechanical lock 70 includes a housing structure 120 which is split vertically into two mirror image halves 121. Each half 121 forms sockets 122 for receipt of cable housing 118. The halves form a lower web or cross piece 123 about which plates 110, 112 pivot. The halves define a pivot aperture 130 located on the center line 132 of the housing. Housing halves 121 may be molded from an engineering plastic and assembled by fasteners extending through apertures 126. This process eliminates the need for a separate cover and simplifies both manufacture and assembly.

A pair of lock plates 110, 112 are positioned within housing 120. Each lock plate defines a lock aperture through which rod 128 passes. Plates 110, 112 are biased to the position shown in FIG. 4 by coil springs 114. When in the position shown, edges 125, 127 of the lock apertures engage the positioner rod 128. The rod is locked and held with respect to housing 120.

Figure 5:
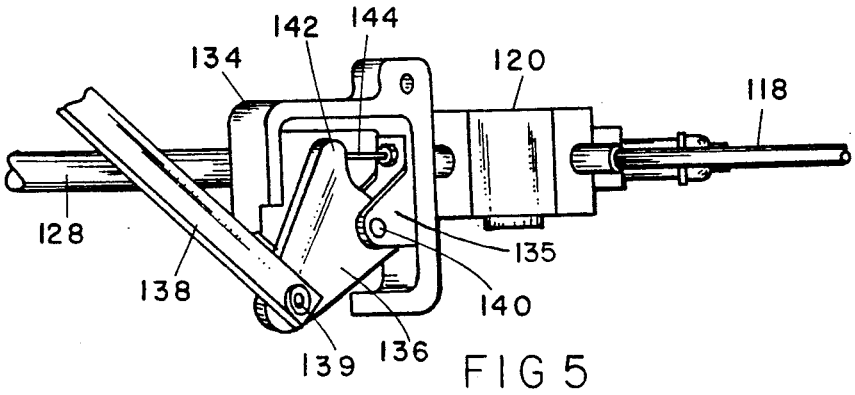
FIG. 5 is a fragmentary, side, elevational view of an alternative bellcrank assembly incorporated in the linear positioner.
Figure 6:
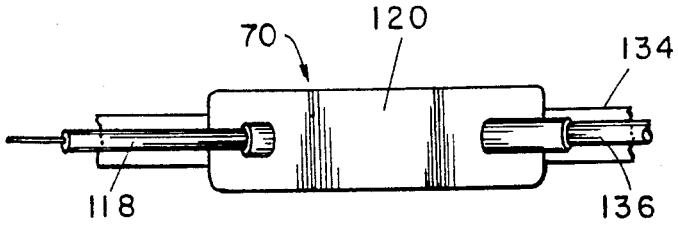
FIG. 6 is a top, elevational view of the linear positioner shown on FIG. 4.

FIGS. 5, 6 illustrate an alternative mechanical lock and actuator. As shown, bellcrank housing 134' differs in configuration from housing 134 of the embodiment of FIG. 3. Housing 134' is a generally rectangular structure having side walls and tabs 135. Bellcrank 142' is pivoted to tabs 135 about a point 140'. Bellcrank 142' includes an arm portion which engages elongated actuator pin 144. Actuator strap 138 is attached to bellcrank 142' by a snap fastener 139.

A cam mechanism 116 pivoted to the housing is provided to move the lock plates 110, 112 away from each other and, hence, to release the rod. Cam mechanism 116 is positioned between upper ends of plates 110, 112 and includes a cam portion 129 and a lever 131. A Bowden cable 115 including an outer sheath or housing 118 and a cable 117 rotates cam 116 by the motion of the actuator ball 119 fixedly attached to cable 117. Cable 115 is routed to an actuator described below in connection with FIGS. 7 and 8.

A bellcrank housing 134 is attached to housing structure 120 at a substantially perpendicular angle. As best seen in FIG. 3, bellcrank housing 134 pivotally mounts a bellcrank 136. An actuator strap 138 is removably attached to one end of the bellcrank. As shown in FIG. 3, strap 138 may attach to the mattress frame of the bed in order to facilitate easy access by the occupant. The soft strap extends out the side of the bed adjacent the upper end of section 24 of the mattress frame. When a pulling force is applied to actuator strap 138, bellcrank mechanism 136 pivots about point 140. The other end 142 of the bellcrank is in engagement with an elongated actuator pin 144. Pin 144 is attached to the free end of a cable 117 (FIG. 4). The pin is pushed inwardly forcing actuator ball 119 to pivot cam mechanism 116 and separate lock plates 110, 112. This releases positioner rod 128. The bed may be adjusted to a desired position. The bellcrank mechanism 116 and actuator strap 138 provide a means for the occupant to easily adjust the bed. The actuator strap 138 is attached to bellcrank 136 by snap fastener 139. The strap, therefore, can be easily removed to eliminate patient or occupant release of the linear positioner.

Figure 7:
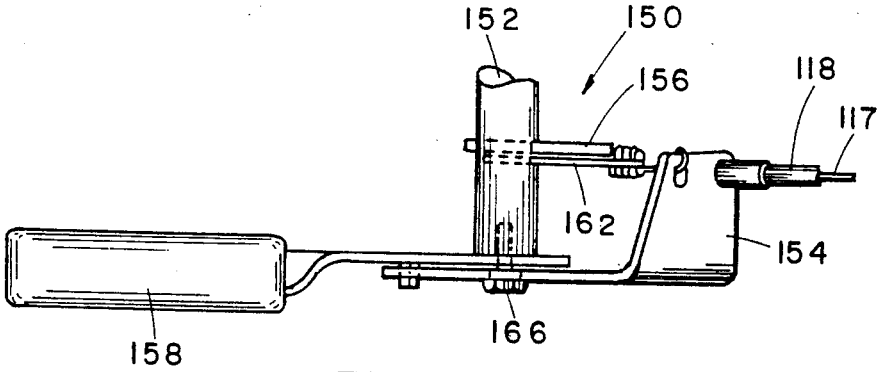
FIG. 7 is a top, elevational view of the back control handle mechanism incorporated in the present invention.
Figure 8:
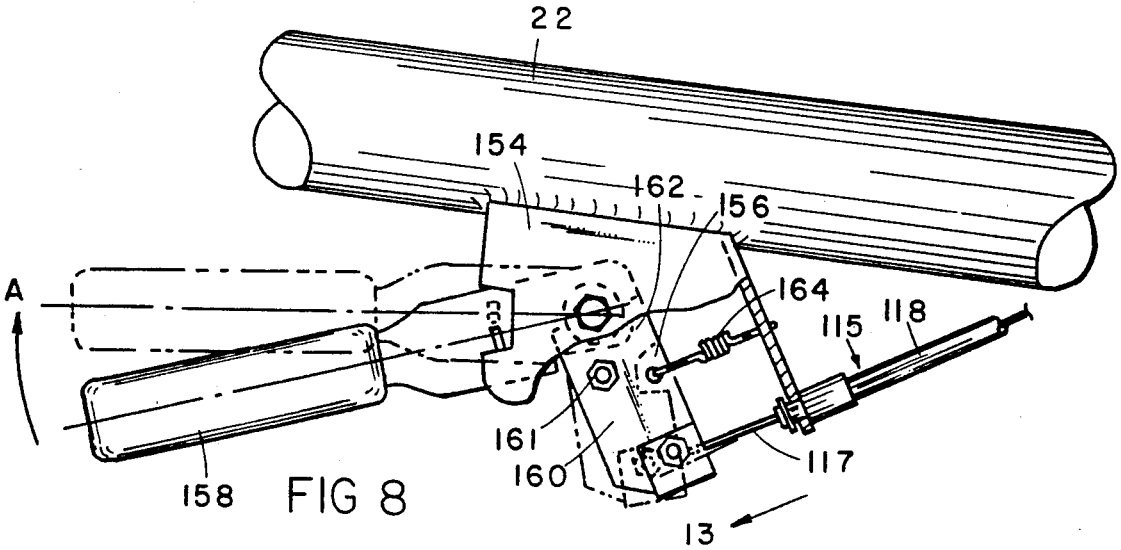
FIG. 8 is a side, elevational view of the back control handle mechanism shown in FIG. 7.

A back mounted attendant control handle mechanism 150 is illustrated in FIGS. 7 and 8. Mechanism 150 includes an override to accommodate pushing movement of the cable upon pulling of the patient strap 138. The mechanism includes a rotatable shaft 152 which extends between brackets 154. Brackets 154 are separately mounted on opposite lateral sides of mattress frame section 22 adjacent the upper end of the mattress frame section. A lever 156 is fixed to shaft 152. Lever 156 is rotated by handle 158 which is also fixed to shaft 152. An override plate 160 is mounted on lever 156. Cable 117 is attached to the override plate 160. In normal operation by the attendant, handle 158 is pivoted upwardly in the direction of arrow A, as shown in FIG. 8. A stop finger 162 on the override plate 160 engages shaft 152 when the plate moves with the lever 156 pulling cable 117 to release the locking plates in the lock mechanism 70. A return spring 164 between lever 156 and bracket 154 biases lever 156 to return it to a lock fixed position.

When cable 117 is pushed in the direction of arrow B by pulling action on strap 138, override plate 160 will pivot at point 161 with respect to lever 156. As can be seen, back control handle mechanism 150, with the accompanying override mechanism, provides a means to accommodate the pushing cable movement provided by bellcrank mechanism 136. This device allows enough free movement in cable 117 when actuator strap 138 is pulled so the cable will not bend or kink as would be the case with a rigid control handle.

Changing of the angular position of the bed sections is easily accomplished. Should the occupant desire to move towards an upright position with the seat back raised with respect to the intermediate or seat section 24, either the cable actuator 150 or actuator strap 138 is pulled which rotates the cam to release the lock plates of lock mechanism 70 which engages rod 64. The occupant's weight will cause seat section 24 to drop at its pivot 30 and head section 22 will tilt about pivot 40. When the desired angular position is reached, cable 117 is released and plates 110, 112 engage lock rod 28. In a similar fashion, the angular position between leg section 26 and seat section 24 is also adjusted. Lock mechanism 70 engaging positioner rod 80 functions in precisely the same fashion as described above. Sections 24, 26 may be shifted to form the knee-break configuration shown in FIG. 2. In the alternative, the lower section of the bed could be formed with a single, elongated section. The seat and foot sections would not be pivoted together. Subassembly 52 would, therefore, be eliminated. The resulting two-section bed may be relatively inexpensively manufactured. The bed could be offered to the lower-end market. The advantages of an adjustable bed may be readily realized in the home environment.

Figure 9:
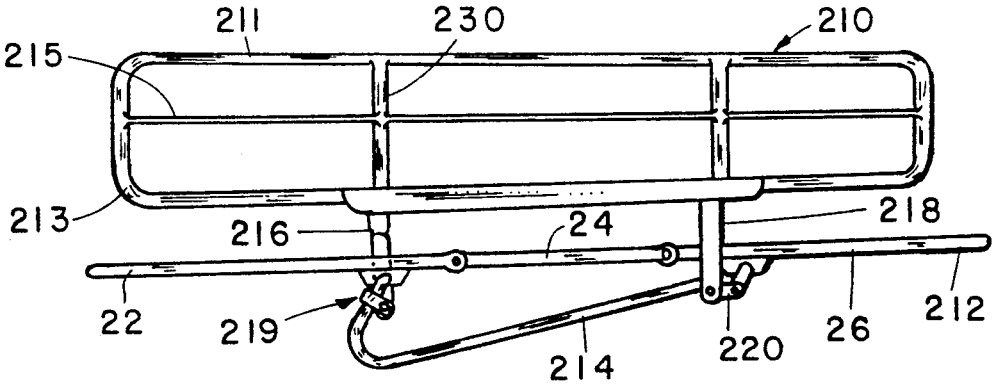
FIG. 9 is a side, elevational view of the bed rail mechanism with the bed in a flat position.

A bed rail assembly in accordance with another aspect of the invention is illustrated in FIG. 9 and generally designated by numeral 210. Bed rail assembly 210 includes a upper rail 211 and lower rail 213 which are joined at their ends to form an elongated, generally rectangular shape. Center support rail 215 and vertical support members 230 may also be included.

Figure 10:
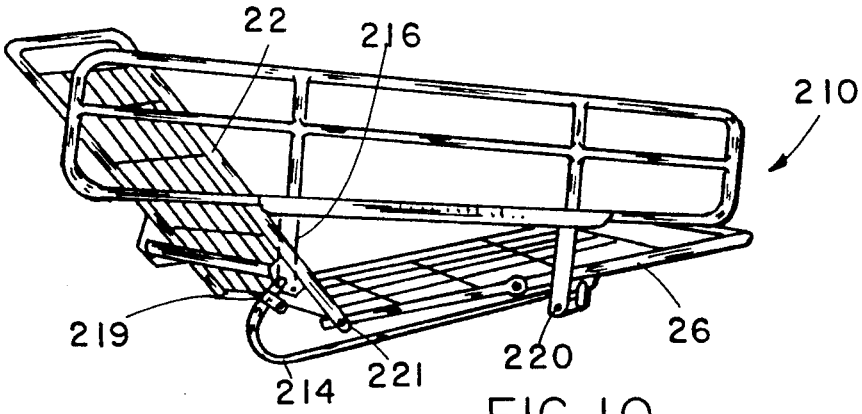
FIG. 10 is a side, elevational view of the bed rail mechanism in a contour position.
Figure 11:
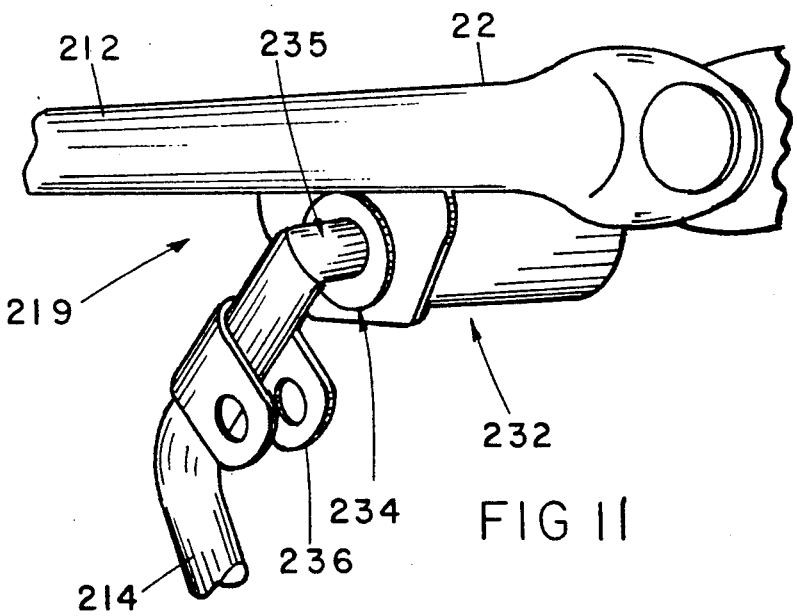
FIG. 11 is a side, elevational view of the upper link assembly.
Figure 12:
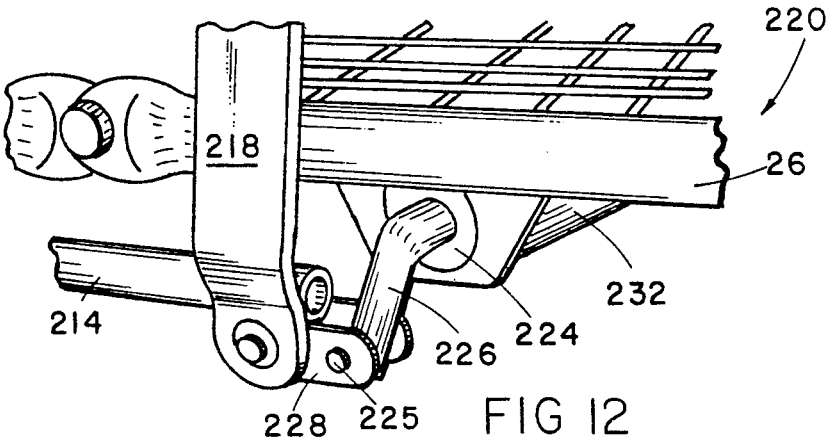
FIG. 12 is a side, elevational view of the idler link assembly.

A first link 216 and a second link 218 are attached at their upper ends to lower rail 213 and pivotally attach at predetermined points at their lower ends to a J-shaped attachment bar 214. Link 216 is illustrated in partial phantom view in order to expose J-shaped attachment bar 214 connected to mattress frame 212. As seen in FIG. 10, when the head section 217 of adjustable mattress frame 212 is pivoted upwardly, the J-shaped attachment bar 214 moves in an upward and forward direction to a point where the straight section of the J-shaped attachment bar 214 is substantially parallel with the remaining sections of the mattress frame below the pivot point 221. This motion is accomplished through the use of a pivot assembly 219 (FIG. 11) and an idler link assembly 220 (FIG. 12).

Pivot assembly 219 includes a support bracket 232 attached to the head section 22 of mattress frame 212. A side rail bushing 234 is fixedly attached to an L-shaped upper end 235 of J-shaped attachment bar 214. Bushing 234 rotates within support bracket 232. An attachment clip 236 pivotally attaches first link 216 to the upper end of bar 214.

Idler link assembly 220 (FIG. 12) includes a support bracket 222 which is fixedly attached to mattress frame section 26. An L-shaped idler link 226 extends into a bushing 224. Bushing 224 is inserted into support bracket 222. An idler bracket 228 is fixed to bar 214 and pivotally attached to the free end of link 226 by pin 225. Link 218 is pivotally attached to bracket 228. This arrangement provides the free movement of the J-shaped attachment bar 214 when the head section of frame 212 is pivoted into an upward position as well as an attachment point for link 218. The bed rail may then be pivoted about the link pivotal attachment points shown in FIG. 9 so the rail may be moved out of the patient's way when access to or exit from the bed is desired.

FIGS. 13–19 depict the side rail bushing or pivot assemblies 222, 232 used to attach J-shaped attachment bar 214 and idler link 226 to the bed frame. Each assembly is identical and is designated by the numeral 250 in FIGS. 15, 16.

Assembly 250 includes a bushing 252 manufactured in mirror image halves of a high impact plastic material. As seen in the cross-sectional view of FIG. 19, each half 251, 253 is held together with integral fastener pins or posts 274, 275. Pins 274, 275 are molded on the interior of each half. When connected, each half forms bushing 252, shown in FIGS. 13, 14. Bushing 252 defines a pair of oppositely disposed chordal flats 254. Chordal flats 254 separate oppositely disposed cylindrical portions 256. Bushing 252 also defines a circular stop section or flange 258 and a recess or peripheral groove 260. Recess 260 extends around the perimeter of bushing 252. Circular flange 258 is of a greater diameter than portion 256 of the bushing.

Figure 15:
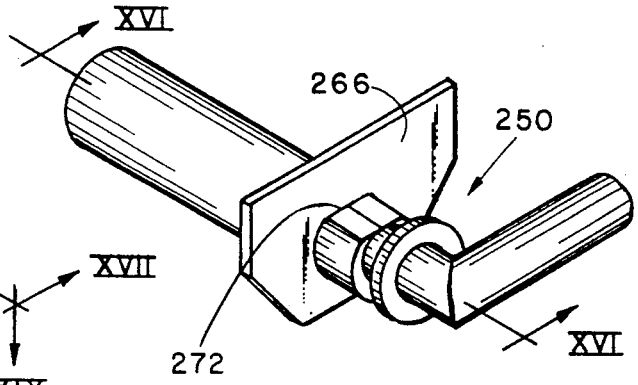
FIG. 15 is a side, elevational view of the side rail bushing assembly partially inserted into a bracket.
Figure 19:
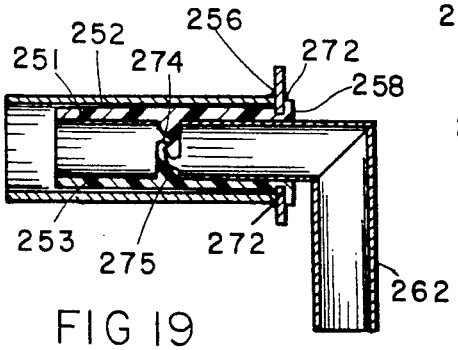
FIG. 19 is a side, cross-sectional view of the side rail bushing assembly shown in FIG. 18.
Figure 13:
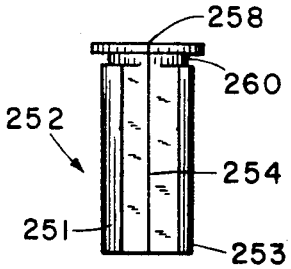
FIG. 13 is a side, elevational view of the side rail bushing showing exposure of the chordal flat.

FIG. 15 illustrates bushing 252 attached to a tubular member 262. Member 262 defines aligned apertures through which fasteners 274, 275 extend. The bushing is, therefore, locked onto the tube. Tubular member 262 represents the end 235 of J-shaped attachment bar 214 of FIG. 11 and the L-shaped link 226 shown in FIG. 12. Brackets 222, 232, illustrated in FIGS. 11 and 12, are the same as bracket 264. Bracket 264 includes a face plate or flange 266 which attaches to mattress frame 212. The face plate defines a non-circular aperture 267, which matches the size, shape and configuration of bushing 252. A cylindrical tube or guide 268 is aligned with aperture 267. Cylindrical guide 268 is fixedly attached to the back of face plate 266 and provides a guide for the bushing 252 when it is inserted into the non-circular aperture. Flat portion 272 of non-circular aperture 267 partially protrudes into the guide channel and acts to guide chordal flat 254 into the cylindrical tube (FIGS. 15, 19).

Figure 16:
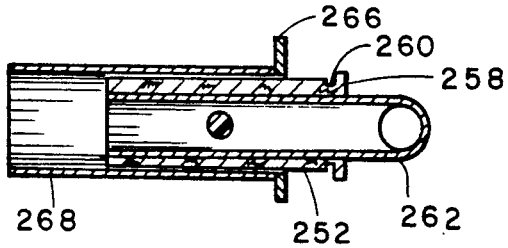
FIG. 16 is a side, cross-sectional view of the partially inserted bracket shown in FIG. 15.

As shown in FIGS. 15 and 16, bushing 252 is aligned with aperture 267 and inserted into cylindrical guide 268. When flange 266 engages bushing flange 258, flange 266 is aligned with groove or recess 260 defined by the busing. In view of the shape of the non-circular aperture 267, bushing 252 can only be inserted longitudinally into cylindrical guide 268 and cannot rotate.

Figure 18:
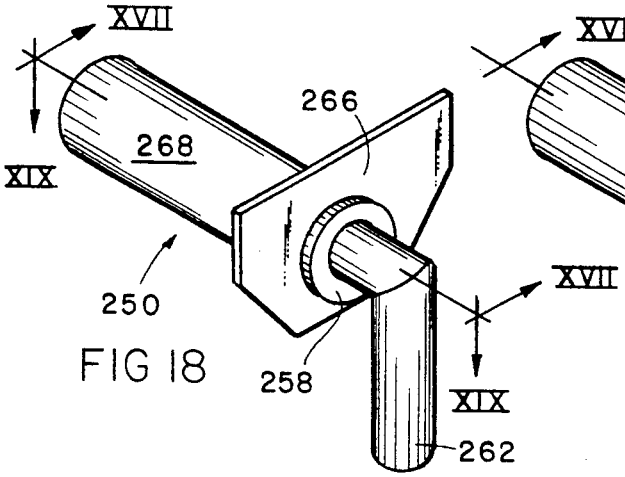
FIG. 18 is a side, elevational view of the side rail bushing assembly fully inserted in a bracket and rotated 90°.
Figure 17:
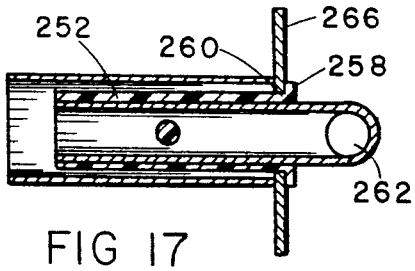
FIG. 17 is a side, cross-sectional view of the side rail bushing assembly fully inserted into a bracket.
Figure 14:
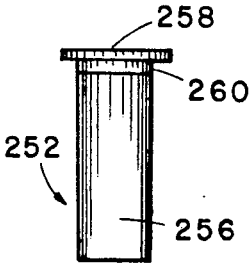
FIG. 14 is the bushing shown in FIG. 13 rotated showing a rounded perimeter.

FIG. 17 illustrates a side, sectional view of bushing 252 fully inserted into cylindrical guide 268. Circular stop section or flange 258 prevents further insertion of the bushing because of contact with face plate 266. FIGS. 18 and 19 show bushing 252 fully inserted into the cylindrical guide 268 and rotated 90° from the position shown in FIG. 15. As shown in FIG. 19, when the bushing is rotated to an orthogonal position, the rounded perimeter 256 of the bushing rotates into a position where it is behind the flat portion 272 of non-circular aperture 267. Since the rounded perimeter 256 of bushing 252 is of a greater diameter than the distance between the flat portions 272 of the non-circular aperture 267, bushing 252 cannot be extracted from cylindrical guide 268. This arrangement allows the bushing to be pivoted in any motion less than 90° without the bushing being able to be withdrawn from the non-circular aperture 267. The bushing can be withdrawn merely by aligning the flats with the flats of the flat portion 272 of aperture 267.

The side rail assembly has the benefits of being used with any type of adjustable bed and can be assembled without the use of tools using the unique side rail bushing assembly. The specific configuration of the J-shaped attachment bar 214 and use of idler link assembly 220 causes the side rail to move up and forward when the bed is tilted. Use of the idler link assembly eliminates any substantial space between the lower rail 213 and a mattress (not shown). Hence, the bed rail does not merely move upward at a fixed point but moves upward and forward eliminating any space that a patient might fall into.

Figure 20:
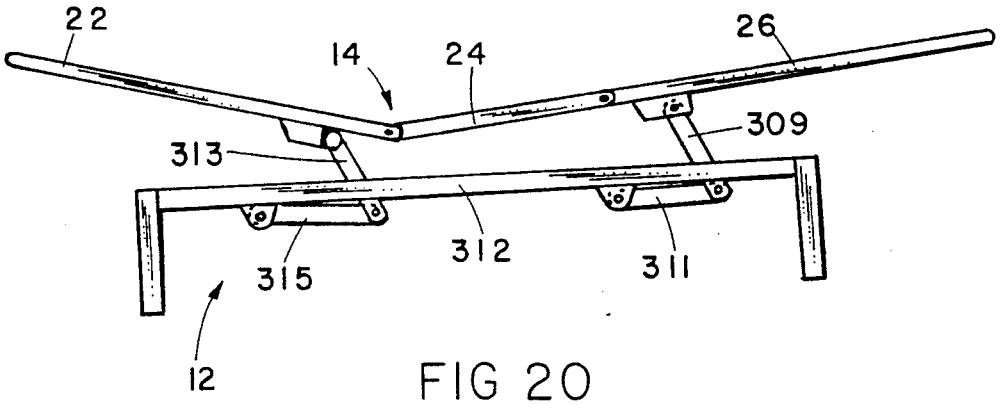
FIG. 20 is a side, elevational view illustrating a high-low mechanism with the foot section of the mattress frame in a raised position.
Figure 21:
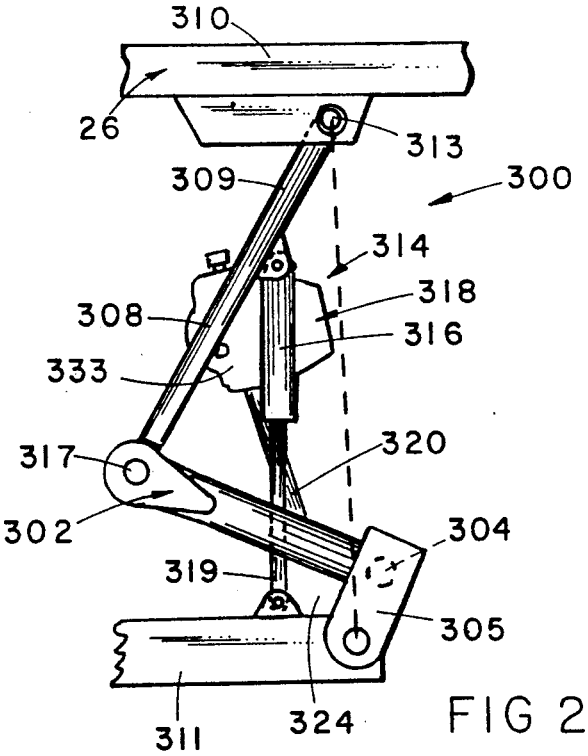
FIG. 21 is a perspective view of the leg lift mechanism of the present invention.
Figure 22:
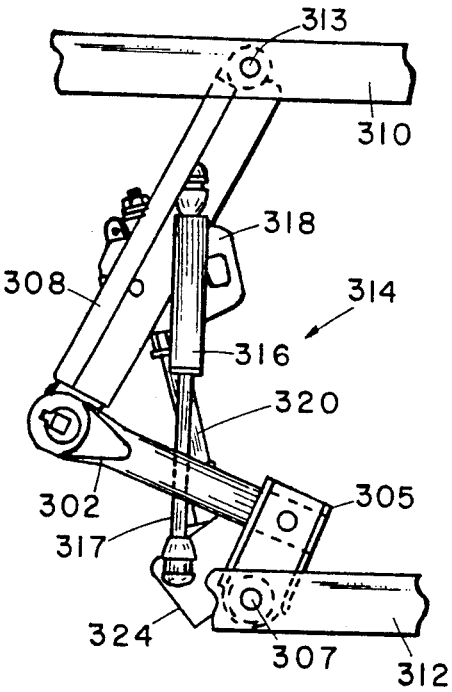
FIG. 22 is a side, elevational view of the leg lift mechanism in an extended position.
Figure 23:
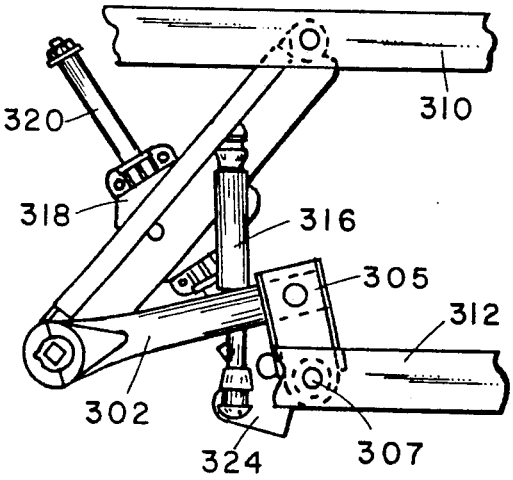
FIG. 23 is a side, elevational view of the leg lift mechanism in the retracted position.
Figure 24:
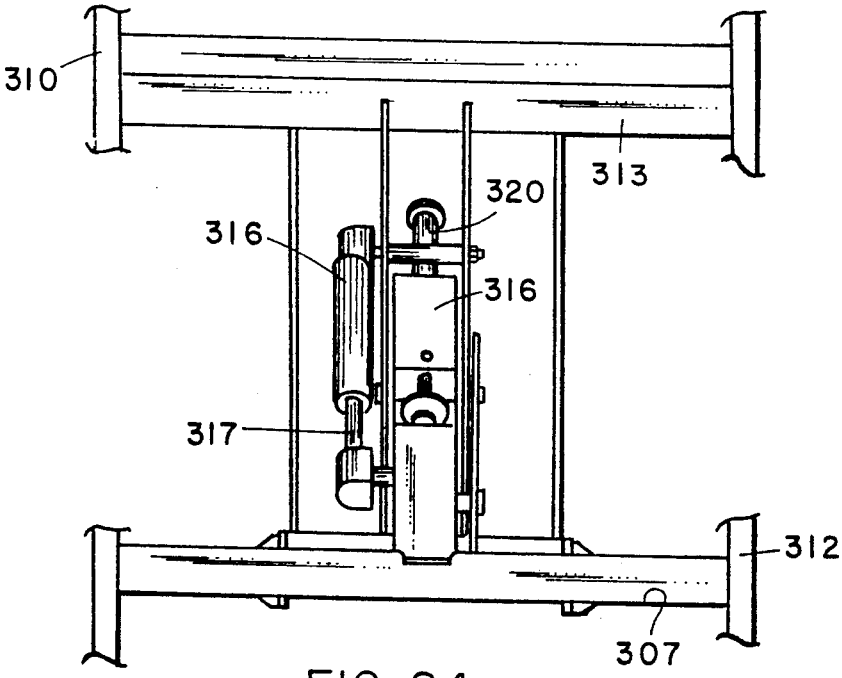
FIG. 24 is a rear, elevational view of the leg lift mechanism shown in an extended position.

FIG. 20 illustrates a mattress frame with sections 22, 24 and 26 mounted on base frame 12 by high-low links 309, 311, 313 and 315. A jack (not shown) may be included to raise the mattress frame. In addition, a leg lift mechanism may be substituted for link 309 or link 42 of the FIG. 1 configuration. A leg lift mechanism allows elevation of the feet above heart level for treatment of edema and other conditions. In accordance with the present invention, a leg lift mechanism, shown in FIGS. 21-24 and generally designated by the numeral 300, is provided. Leg lift mechanism 300 includes a lower link assembly 302 fixed to a shaft 304 which is pivoted by a pivot section 305 to the upper end of links 311, for example. In FIGS. 22 and 23, assembly 300 is pivoted to a base frame member 312. An upper link assembly 308 is fixed to a shaft 313 at an upper end 309. Shaft 313 is, in turn, attached to mattress frame portions 310. Links 302, 308 are pivoted together at shaft 317 in a jackknife-like or scissors-like fashion. A mechanical positioner subassembly, generally designated 314, includes a gas spring 316. Spring 316 controls the rate of collapsing movement of the leg lift mechanism. Gas spring 316 is attached at its upper end to the upper portion of upper link assembly 308 and at its lower end 319 to mounting section 324 which extends from shaft 304.

Positioner 314 further includes a lock assembly 318 and a positioner rod 320. Rod 320 is pivoted at a lower end to a bracket 324. Bracket 324 is joined to shaft or tube 304. Housing 333 of lock assembly 318 is pivoted to link assembly 308. Lock assembly 318 includes locking plates, a cam and a cable actuator as in assembly 70.

In use, lock assembly 318 is released, permitting the lower end of the mattress frame to be raised. Links 302, 308 open and rod 320 moves from the position shown in FIG. 23 to the position shown in FIG. 24. When assembly 318 locks onto rod 320, links 302, 308 are held in position.

In view of the above description, those of ordinary skill in the art may envision various modifications which would not depart from the inventive concepts disclosed. It is expressly intended, therefore, that the above should be considered only as a description of the preferred embodiment. The true spirit and scope of the present invention may be determined by reference to the appended claims.

The embodiments of the invention in which an exclusive property or privilege is claimed are defined as follows:

1. A side rail assembly for an adjustable bed having a multi-section frame, said assembly comprising:

an elongated side rail;

a configured, elongated attachment bar;

link means for attaching said side rail to said attachment bar;

first pivot means engaging an end of said attachment bar for attaching said end to one section of the bed frame;

an idler link having an end pivoted to said attachment bar; and second pivot means supporting another end of said idler link for pivoting said idler link to another section of the bed frame.

2. A side rail assembly as defined by claim 1 wherein said attachment bar is generally J-shaped in elevation.

3. A side rail assembly as defined by claim 1 wherein said first pivot means comprises:

a bar bracket having a cylindrical portion and a face plate with a non-circular aperture; and a bushing on said attachment bar and disposed within said cylindrical portion, said bushing having an elongated portion with a non-circular cross section conforming to the shape of said aperture, a flange and a peripheral groove adjacent said flange.

4. A side rail assembly as defined by claim 3 wherein said bushing comprises:

first and second half members, each member defining a fastener post, said posts extending through aligned apertures in said attachment bar.

5. A side rail assembly as defined by claim 1 wherein said second pivot means comprises:

an idler bracket having a cylindrical portion and a face plate with a non-circular aperture; and a bushing on said idler link and disposed within said idler bracket, said bushing having an elongated portion conforming to the shape of said aperture, a peripheral groove dimensioned to receive said face plate and a stop flange.

6. A side rail assembly as defined by claim 5 wherein said first pivot means comprises:

a bar bracket having a cylindrical portion and a face plate with a non-circular aperture; and a bushing on said attachment bar and disposed within said cylindrical portion, said bushing having an elongated portion with a non-circular cross section conforming to the shape of said aperture, a flange and a peripheral groove adjacent said flange.

7. A side rail assembly as defined by claim 6 wherein each of said bushings comprises: first and second half members, each member defining a fastener post, said posts extending through apertures in said bar and said link, respectively.

8. A side rail assembly as defined by claim 7 wherein said attachment bar is generally J-shaped in elevation.

* * * * *